US005791547A

United States Patent [19]

Yang

[11] Patent Number: 5,791,547

[45] Date of Patent: Aug. 11, 1998

[54] NAIL TRACK AND NAIL OUTPUT HEAD ARRANGEMENT OF A NAILING GUN

[75] Inventor: Brad Yang, Taichung Hsien, Taiwan

[73] Assignee: Testo Industry Corp., Taipei, Taiwan

[21] Appl. No.: 942,388

[22] Filed: Oct. 10, 1997

[51] Int. Cl.[6] ..... B25C 1/04

[52] U.S. Cl. ..... 227/120; 227/123

[58] Field of Search ..... 227/123, 120, 227/130, 119, 109

[56] References Cited

U.S. PATENT DOCUMENTS

| | | | |
|---|---|---|---|
| 4,389,012 | 6/1983 | Grikis et al. | 227/109 |
| 4,524,896 | 6/1985 | Morrell, Jr. | 227/109 |
| 4,621,758 | 11/1986 | Anstett | 227/109 |
| 4,903,880 | 2/1990 | Austin et al. | 227/120 |
| 5,641,110 | 6/1997 | Yang | 227/120 |

*Primary Examiner*—Scott A. Smith
*Attorney, Agent, or Firm*—Donald C. Casey, Esq.

[57] ABSTRACT

A nail track and nail output head arrangement which includes a nail track having a longitudinal nail guide wall, the nail guide wall having a side lug and a flanged to notch, and a nail output head having an integral mounting plate at an inner side and defining a substantially U-shaped nail output port, the mounting plate having two parallel lugs perpendicularly disposed adjacent to one end of the U-shaped nail output port and bilaterally pivoted to the lug of the nail track, an upright locating plate surrounded by the U-shaped nail output port and forced into engagement with the notch of the nail track, and a nail guide plate perpendicularly disposed adjacent to an opposite end of the U-shaped nail output port.

1 Claim, 4 Drawing Sheets

NAIL TRACK AND NAIL OUTPUT HEAD ARRANGEMENT OF A NAILING GUN

BACKGROUND OF THE INVENTION

The present invention relates to nailing guns, and more specifically to a nail track and nail output head arrangement for a nailing gun.

FIG. 1 shows a nail track and nail output head arrangement for a nailing gun according to the prior art. This arrangement comprises a nail track 20 on which U-nails 21 are loaded, a guide block 12 integral with the top end of the nail track 20, and a nail output head 10 coupled to the guide block 12 and defining with the guide block 12 a substantially U-shaped nail output port 11 through which the nails 21 are driven out of the nail output port 11 in proper order by a driving element 22. Because the nail output head 10 and the guide block 12 are two separated members, they must be fastened together by fastening means. Further, the guide block 12 and the nail track must be molded together by a precision mold, and the nail track 20 must be processed to provide a nail guide wall 22. FIG. 2 shows another arrangement of the nail track and the guide block, in which the nail track 40 and the guide block 30 are separately made, and then fastened together by welding. Because the guide block 30 is welded to the nail track 40, dregs 31 are left around the connecting area between the guide block 30 and the nail track 40, and an additional finishing process must be employed to remove the dregs 31. FIG. 2B shows another arrangement of the nail track and the guide block, in which the guide block 50 has a plurality of downward mounting plates 51 respectively fastened to the nail track 60 by locating pins 61. This installation procedure is complicated. Further, the connection between the mounting plates 51 of the guide block 50 and the nail track 60 wears quick with use, thereby causing the guide block 50 to vibrate when nailing.

SUMMARY OF THE INVENTION

The present invention has been accomplished to provide a nail track and nail output head arrangement which eliminates the aforesaid drawbacks. According to the present invention, the nail track and nail output head arrangement comprises a nail track having a longitudinal nail guide wall, the nail guide wall having a side lug and a flanged to notch, and a nail output head having an integral mounting plate at an inner side and defining a substantially U-shaped nail output port, the mounting plate having two parallel lugs perpendicularly disposed adjacent to one end of the U-shaped nail output port and bilaterally pivoted to the lug of the nail track, an upright locating plate surrounded by the U-shaped nail output port and forced into engagement with the notch of the nail track, and a nail guide plate perpendicularly disposed adjacent to an opposite end of the U-shaped nail output port.

DETAILED DESCRIPTION OF THE PREFERRED EMBODIMENT

Figure 1:
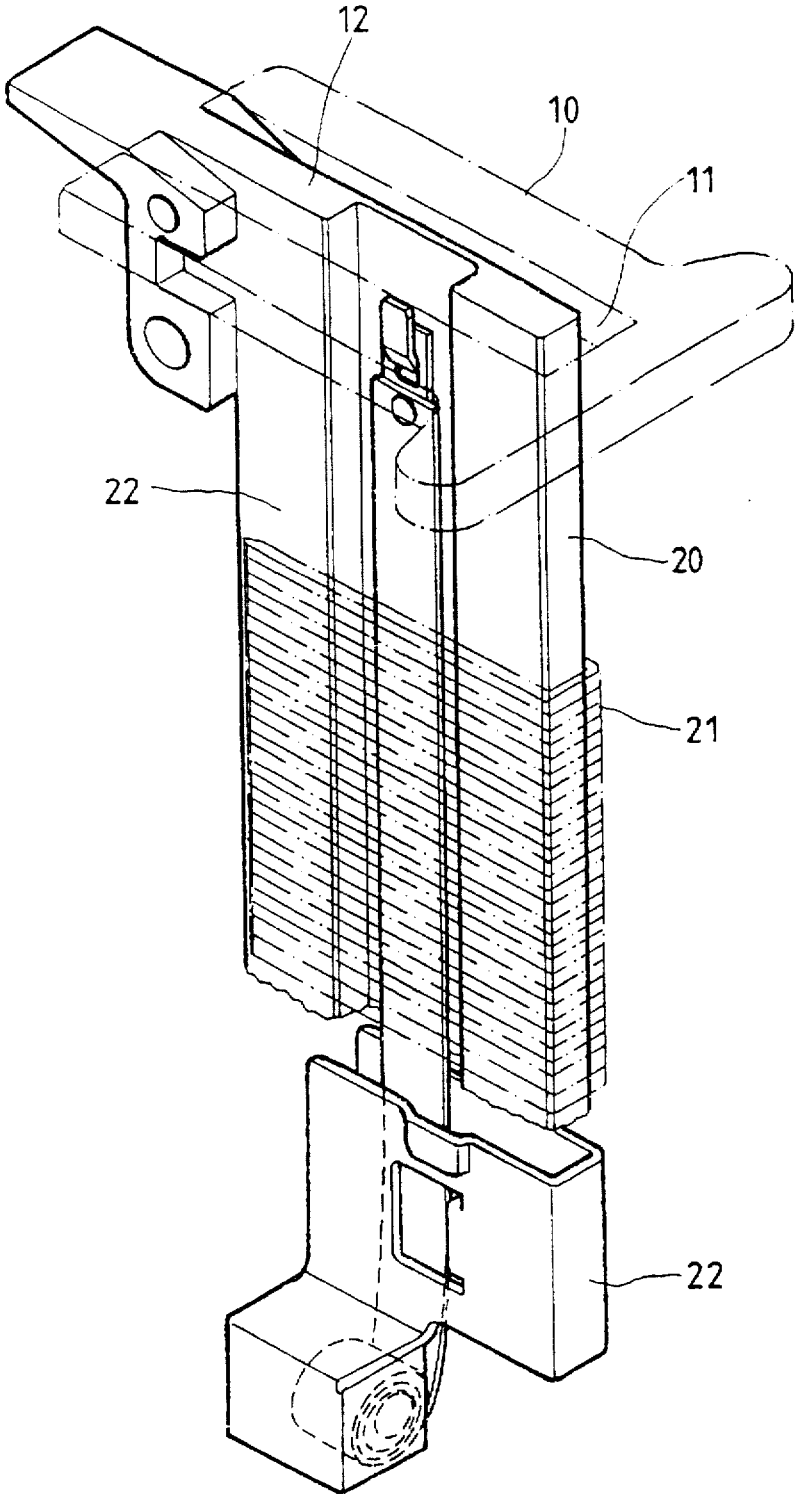
FIG.1(PRIOR ART)
FIG. 1 is a perspective view showing a nail track and nail output head arrangement according to the prior art.
Figure 2A:
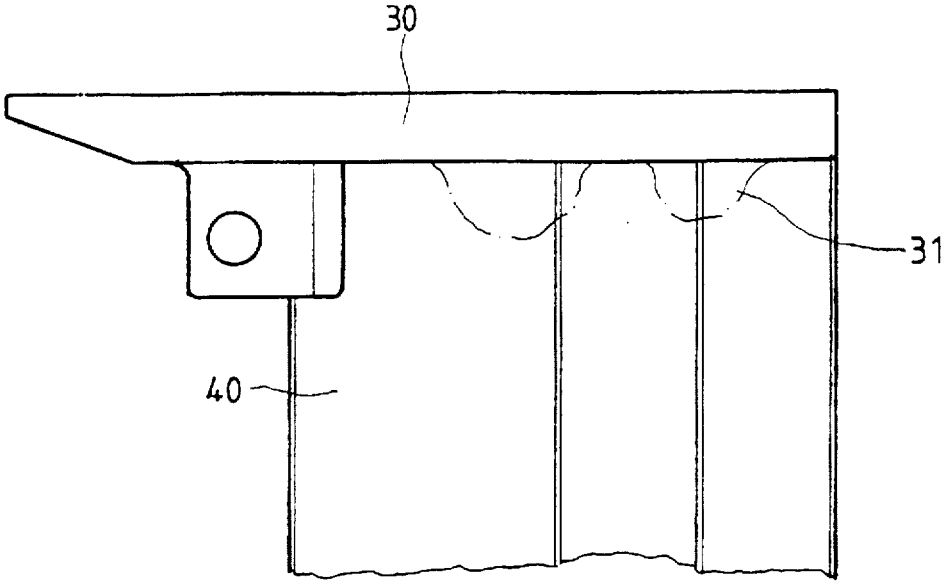
FIG.2A(PRIOR ART)
FIG. 2A shows a connection between a guide block and a nail track according to the prior art.
Figure 2B:
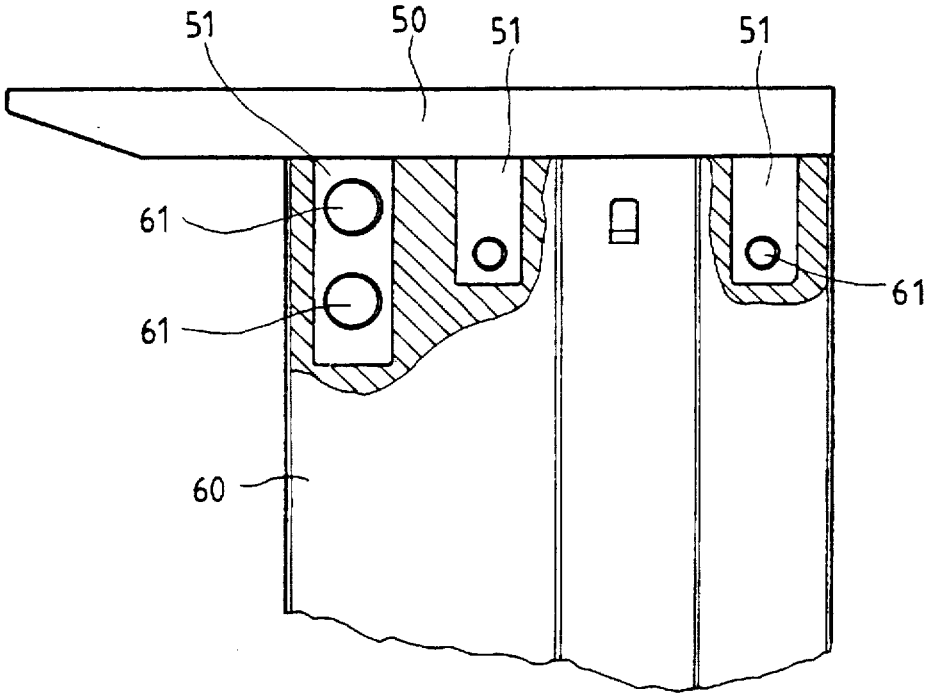
FIG.2B(PRIOR ART)
FIG. 2B shows another connection between a guide block and a nail track according to the prior art.
Figure 3:
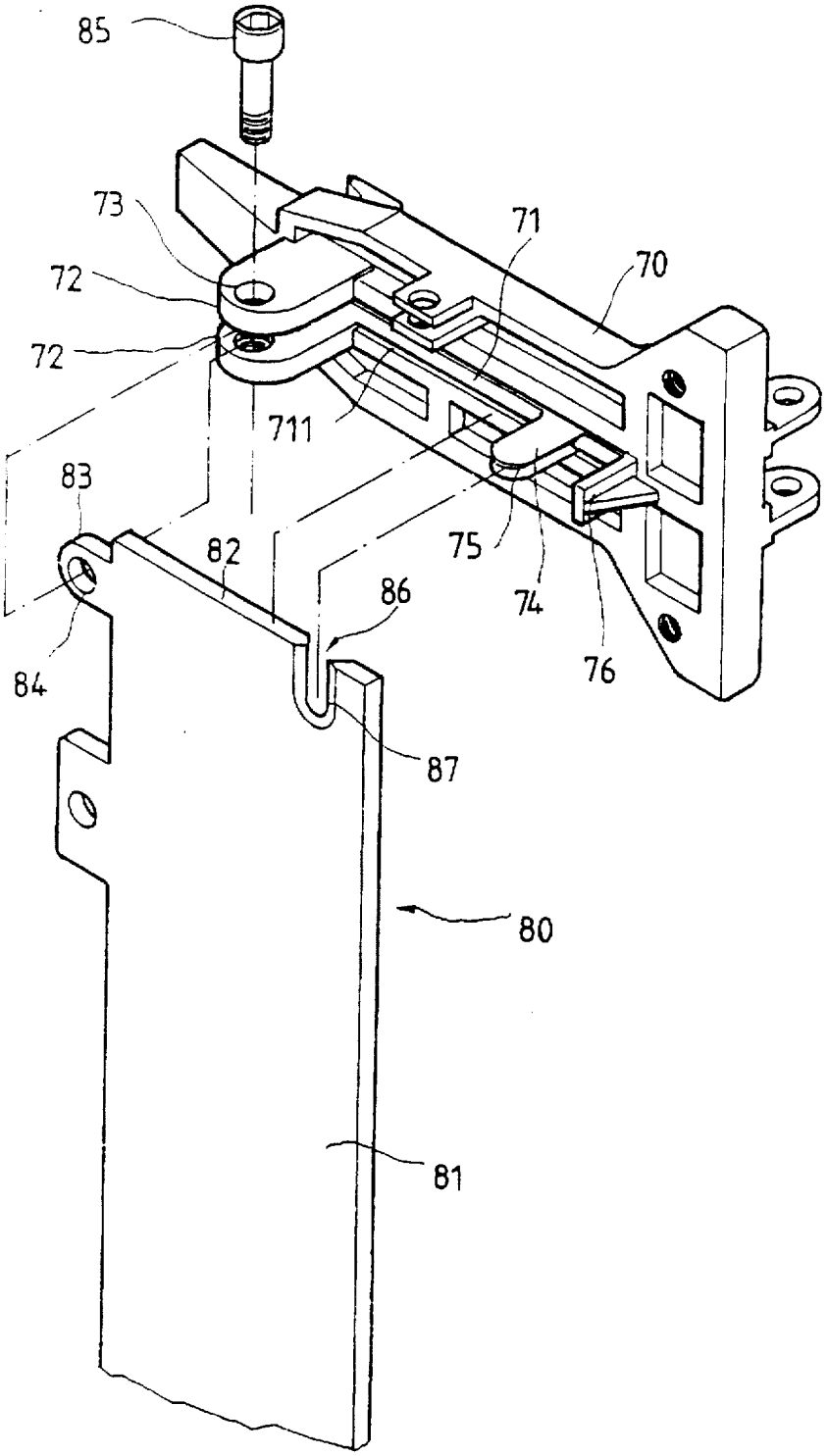
FIG. 3 is an exploded view of a nail track and nail output head arrangement according to the present invention.

Referring to FIG. 3, the nail output head, referenced by 70, is shaped like a wedge block. A mounting plate 71 is integral with the nail output head 70, defining a substantially U-shaped nail output port 711. The mounting plate 71 comprises two parallel lugs 72 perpendicularly raised from its inner side adjacent to one end (namely, the open end) of the U-shaped nail output port 711, the lugs 72 having a respective mounting hole 73, a locating plate 74 perpendicularly raised from its inner side and surrounded by the U-shaped nail output port 711, the locating plate 74 having a V-groove 75 extended along its periphery, and a nail guide plate 76 perpendicularly raised from its inner side adjacent to an opposite end (namely, the close end of the U-shaped nail output port 711. The nail track, referenced by 80, is a flat board comprising a longitudinal nail guide wall 81, a lug 83 extended sideways from the top end 82 of the nail guide wall 81 and adapted for inserting in between the parallel lugs 72 of the mounting plate 71, the lug 83 has a mounting hole 84, a notch 86 at the top end 82 of the nail guide wall 81 corresponding to the locating plate 74 of the mounting plate 71, and a locating flange 87 raised along the border of the notch 86 and having a substantially V-shaped cross section.

Figure 4:
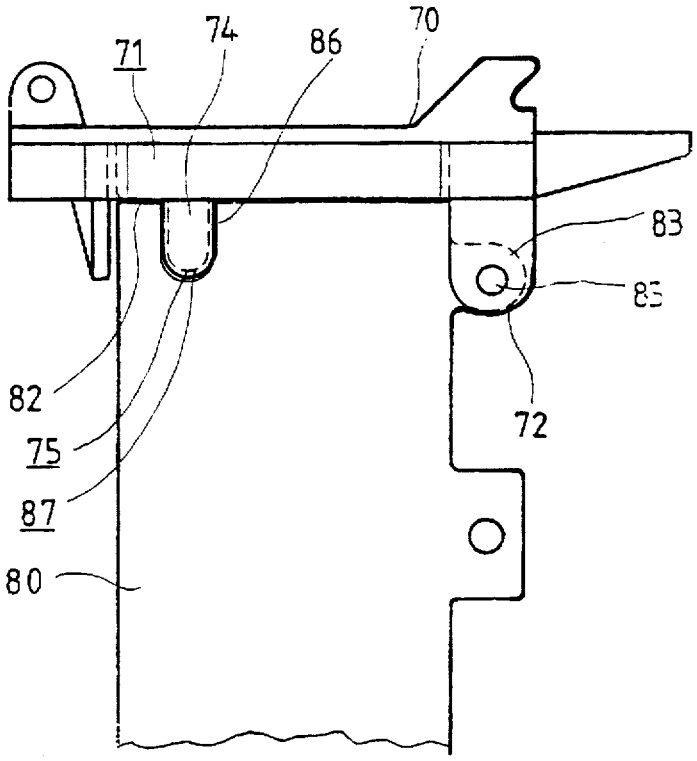
FIG. 4 is a side plain view of the present invention, showing the mounting plate fastened to the nail track.

The assembly process of the invention is simple, and outlined hereinafter with reference to FIGS. 3 and 4. The top end 82 of the nail track 80 is aimed at the mounting plate 71. Then, the lug 83 of the nail track 80 is inserted in between the parallel lugs 72 of the mounting plate 71, and the locating plate 74 of the mounting plate 71 is inserted into the notch 86 of the nail track 80, permitting the locating flange 87 to be forced into engagement with the V-groove 75. Then, a screw bolt 85 is fastened to the mounting holes 73 of the parallel lugs 72 of the mounting plate 71 and the mounting hole 83 of the lug 84 of the nail track 80 to secure the lugs 72;83 together. When assembled, the mounting plate 71 with the nail output head 70 can be turned about the screw bolt 85 between the operative position and the non-operative position. When the mounting plate 71 with the nail output head 70 are turned to the operative position, the V-groove 75 of the locating plate 74 is forced into engagement with the locating flange 87 in the notch 86 of the nail track 80, and therefore the mounting plate 71 with the nail output head 70 can be stably retained in the operative position.

What the invention claimed is:

1. A nail track and nail output head arrangement comprising:

a nail track having a longitudinal nail guide wall, said nail guide wall having a front end, a lug extended sideways from the front end of said nail guide wall, a notch at the front end of said nail guide wall, and a locating flange raised along the border of said notch and having a substantially V-shaped cross section; and a nail output head having an integral mounting plate at an inner side and defining a substantially U-shaped nail output port, said mounting plate comprising two parallel lugs perpendicularly disposed adjacent to one end of said U-shaped nail output port and bilaterally coupled to the lug of said nail track by a screw bolt for permitting said nail output head with said mounting plate to be turned about said screw bolt, an upright locating plate surrounded by said U-shaped nail output port and adapted to engage into said notch of said nail track, said locating plate having a V-groove extended along the periphery, said V-groove being forced into engagement with said locating flange in said notch of said nail track when said locating plate is forced into said notch of said nail track, and a nail guide plate perpendicularly disposed adjacent to an opposite end of said U-shaped nail output port.

* * * * *